US010455661B2

(12) United States Patent
Harada et al.

(10) Patent No.: US 10,455,661 B2
(45) **Date of Patent: *Oct. 22, 2019**

(54) ILLUMINATION APPARATUS AND ILLUMINATION CONTROL SYSTEM

(71) Applicant: PANASONIC INTELLECTUAL PROPERTY MANAGEMENT CO., LTD., Osaka (JP)

(72) Inventors: Kazuki Harada, Osaka (JP); Yoko Matsubayashi, Osaka (JP); Makoto Yamada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/039,431

(22) Filed: Jul. 19, 2018

(65) Prior Publication Data

US 2019/0037654 A1 Jan. 31, 2019

(30) Foreign Application Priority Data

Jul. 26, 2017 (JP) ..... 2017-144839

(51) Int. Cl.
*H05B 33/08* (2006.01)

(52) U.S. Cl.
CPC ..... *H05B 33/086* (2013.01); *H05B 33/0872* (2013.01)

(58) Field of Classification Search
CPC .. H05B 33/08; H05B 33/086; H05B 33/0842; H05B 33/0857; H05B 33/0872; H05B 37/02
See application file for complete search history.

(56) References Cited

U.S. PATENT DOCUMENTS

| | | | | |
|---|---|---|---|---|
| 9,544,968 | B2 | 1/2017 | Matsubayashi et al. | |
| 10,034,345 | B1 | 7/2018 | Matsubayashi et al. | |
| 2007/0268694 | A1* | 11/2007 | Bailey | G02B 27/0955 362/231 |
| 2007/0291467 | A1* | 12/2007 | Nagai | H05B 33/0857 362/84 |
| 2012/0086338 | A1* | 4/2012 | Kim | H05B 33/0815 315/86 |

(Continued)

FOREIGN PATENT DOCUMENTS

| | | | |
|---|---|---|---|
| JP | 2006-349835 | A | 12/2006 |
| JP | 2013-182820 | A | 9/2013 |

(Continued)

OTHER PUBLICATIONS

U.S. Appl. No. 16/135,241 to Naoko Takei et al., filed Sep. 19, 2018.

*Primary Examiner* — Thai Pham
(74) *Attorney, Agent, or Firm* — Greenblum & Bernstein, P.L.C.

(57) ABSTRACT

An illumination apparatus includes: a light emitter which emits first illumination light that is illumination light for illuminating a display, wherein the first illumination light has a correlated color temperature in a range from 4000 K to 5800 K, and u'v' chromaticity coordinates in an XYZ colorimetric system in a range which satisfies 0.7125u'+0.3284<v'<0.7125u'+0.3339.

19 Claims, 15 Drawing Sheets

(56) References Cited

U.S. PATENT DOCUMENTS

| | | | | |
|---|---|---|---|---|
| 2013/0229113 | A1* | 9/2013 | Toda | H05B 37/02 315/152 |
| 2018/0153018 | A1 | 5/2018 | Matsubayashi et al. | |
| 2018/0311386 | A1* | 11/2018 | Hawkins | H05B 33/0857 |

FOREIGN PATENT DOCUMENTS

| | | | | |
|---|---|---|---|---|
| JP | 2014-075186 | A | | 4/2014 |
| JP | 2014075186 | A | * | 4/2014 |

* cited by examiner

ILLUMINATION APPARATUS AND ILLUMINATION CONTROL SYSTEM

CROSS REFERENCE TO RELATED APPLICATION

This application claims the benefit of priority of Japanese Patent Application Number 2017-144839 filed on Jul. 26, 2017, the entire content of which is hereby incorporated by reference.

BACKGROUND

1. Technical Field

The present disclosure relates to an illumination apparatus and an illumination control system, and in particular to an illumination apparatus which can improve the visibility of text on a display, and an illumination control system which includes a plurality of the illumination apparatuses.

2. Description of the Related Art

Various examinations have been made on ambient light emitted while a user is working on a task. For example, an illumination apparatus is used in order to improve the visibility of text on paper during a visual task of viewing text on a document on a desk, for instance.

In view of this, examinations have been made to achieve an illumination apparatus which further increases the visibility of text on paper, compared to a conventional apparatus. For example, Japanese Unexamined Patent Application Publication No. 2014-075186 discloses an illumination apparatus which emits illumination light that allows text on paper to be readily read, by making the paper appear whiter.

SUMMARY

In recent years, most of the visual tasks in, for instance, an office have been visual display terminal (VDT) operations conducted using a display such as a liquid crystal display monitor. Accordingly, there has been a demand for an environment in which improvement in text readability is achieved by improving text visibility during a VDT operation, and studies have been conducted from various viewpoints, in addition to the viewpoint focusing on ambient light emitted by an illumination apparatus. For example, Japanese Unexamined Patent Application Publication No. 2006-349835 proposes a method for adjusting the color of a color monitor such that a colorimetric value matches a reference colorimetric value.

However, how text on a screen appears which mainly depends on the display function of a display has been merely examined so far, and a relation between an illumination environment (ambient light) and a display in order to improve visibility of text has not been revealed.

In addition, although a display setting considered to be suitable for users can be set for a display, a user does not know which display setting is suitable, and thus often uses the display with the display setting originally set when purchased.

Accordingly, it cannot be said that a conventional illumination apparatus emits optimal illumination light for illuminating a display, thus failing to provide ambient light which improves the visibility of text on the display.

The present disclosure has been conceived to address such a problem, and provides an illumination apparatus and an illumination control system which can improve visibility of text on a display.

In order to provide such an illumination apparatus and such an illumination control system, an illumination apparatus according to an aspect of the present disclosure includes: a light emitter which emits first illumination light that is illumination light for illuminating a display, wherein the first illumination light has a correlated color temperature in a range from 4000 K to 5800 K, and u'v' chromaticity coordinates in an XYZ colorimetric system in a range which satisfies $0.7125u'+0.3284<v'<0.7125u'+0.3339$.

An illumination control system according to an aspect of the present disclosure is an illumination control system which includes a plurality of illumination apparatuses each of which includes a light emitter which emits first illumination light that is illumination light for illuminating a display, wherein: the first illumination light has a correlated color temperature in a range from 4000 K to 5800 K, and u'v' chromaticity coordinates in an XYZ colorimetric system in a range which satisfies $0.7125u'+0.3284<v'<0.7125u'+0.3339$, the plurality of illumination apparatuses each include an illuminance detector which detects an illuminance in a predetermined space, and a controller included in a first illumination apparatus changes output of the first illumination light emitted by the light emitter included in the first illumination apparatus, to cause an illuminance in the predetermined space detected by the illuminance detector included in the first illumination apparatus to match an illuminance in the predetermined space detected by the illuminance detector included in a second illumination apparatus different from the first illumination apparatus, the first illumination apparatus and the second illumination apparatus being included in the plurality of illumination apparatuses.

The visibility of text on a display can be improved.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Figure 1:
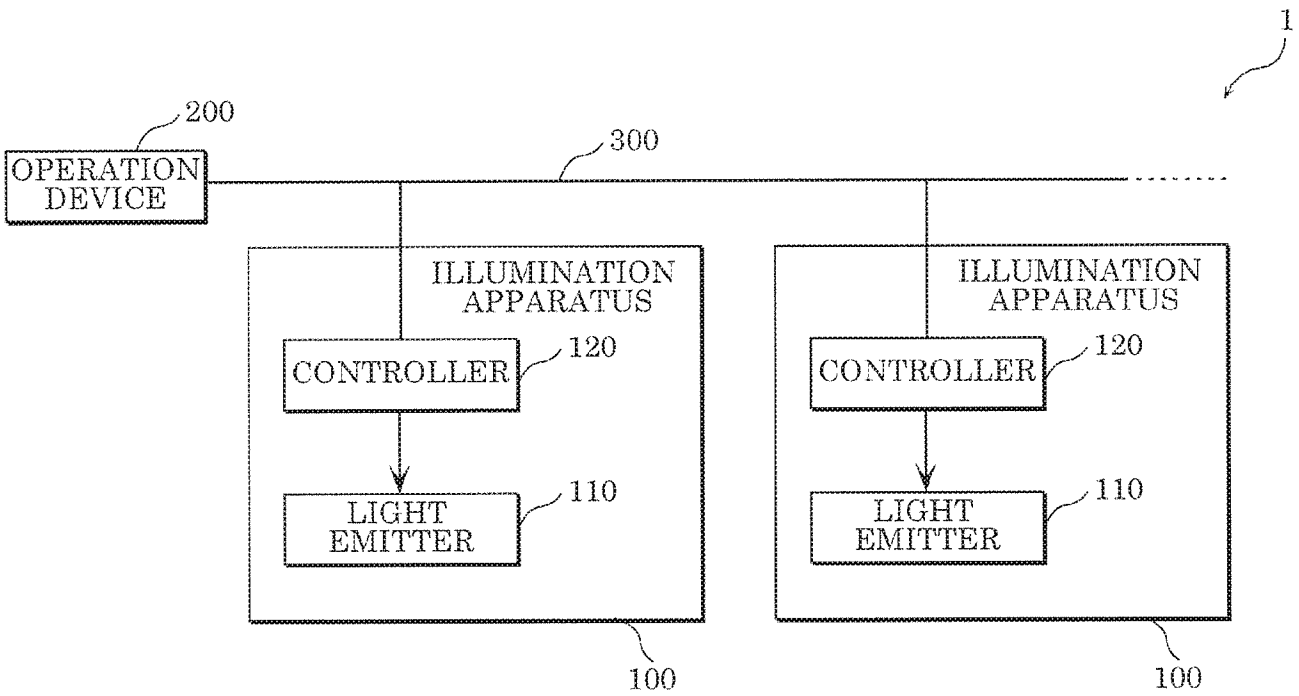
FIG. 1 illustrates a functional configuration of an illumination control system according to Embodiment 1.

The following describes embodiments of the present disclosure. Note that the embodiments described below each show a specific example of the present disclosure. Thus, the numerical values, elements, the arrangement and connection of the elements, steps, and the processing order of the steps, for instance, shown in the following embodiments are mere examples, and thus are not intended to limit the present disclosure. Therefore, among the elements in the embodiments below, elements not recited in any of the independent claims defining the broadest concept of the present disclosure are described as arbitrary elements.

The drawings are schematic diagrams and do not necessarily provide strict illustration. Note that in the drawings, the same numeral is given to a substantially same configuration, and a redundant description thereof may be omitted or simplified.

In the specification and the drawings, the X axis, the Y axis, and the Z axis represent three axes of a three-dimensional orthogonal coordinate system. In the embodiments, the Z-axis direction is a vertical direction, and a direction perpendicular to the Z axis (a direction parallel to the X-Y plane) is a horizontal direction. The X axis and the Y axis are orthogonal to each other, and are both orthogonal to the Z axis.

Embodiment 1

First, a functional configuration of illumination control system 1 according to Embodiment 1 is to be described with reference to FIG. 1. FIG. 1 illustrates a functional configuration of illumination control system 1 according to Embodiment 1.

As illustrated in FIG. 1, illumination control system 1 includes one or more illumination apparatuses 100 and operation device (operation input controller) 200 which controls one or more illumination apparatuses 100. In the present embodiment, plural illumination apparatuses 100 are included, and operation device 200 can control plural illumination apparatuses 100.

Illumination apparatus 100 is disposed in a predetermined space (such as a room) in an office or a residence, for example. In the present embodiment, illumination apparatus 100 is disposed as an ambient lighting fixture for a room in which a display that a user uses for a visual task is placed. The display is placed on a desk, for example. In this case, a horizontal illuminance of illumination light emitted by illumination apparatus 100 may be at most 1000 lx.

Each illumination apparatus 100 includes light emitter 110, and controller 120 which controls light emitter 110.

Light emitter 110 is a light source of illumination apparatus 100, and emits illumination light. Light emitter 110 is configured so as to be able to control color tuning and/or dimming.

Controller 120 includes, for example, a control circuit for controlling dimming and/or color tuning of light emitter 110, and controls optical characteristics of illumination light emitted by light emitter 110. For example, controller 120 controls the color of illumination light emitted by light emitter 110 through color tuning control of light emitter 110, and controls the illuminance of illumination light emitted by light emitter 110 through dimming control of light emitter 110. In the present embodiment, controller 120 controls light emitter 110 to cause light emitter 110 to emit illumination light for improving visibility of text on a display.

Operation device 200 is operation equipment which has an operation screen and/or an operation button for controlling plural illumination apparatuses 100. For example, operation device 200 includes a touch panel having a display screen as an input screen for receiving user operations.

Operation device 200 is connected with plural illumination apparatuses 100 via communication lines 300. Note that operation device 200 may be configured to be able to communicate with plural illumination apparatuses 100 via wireless communication, rather than wired communication. Operation device 200 may be configured to control illumination apparatuses 100 individually, or may be configured to simultaneously control illumination apparatuses 100 in the same manner.

A user operates operation device 200 so that dimming and color tuning of illumination apparatuses 100 can be controlled. For example, when a user desires to adjust the color of illumination light from illumination apparatus 100, the user operates operation device 200 to cause the illumination light to have a desired color. This user operation causes operation device 200 to transmit a color tuning signal to controller 120 of illumination apparatus 100 via communication line 300, so that the color of illumination light emitted by light emitter 110 changes. When a user desires to adjust the brightness of illumination light from illumination apparatus 100, the user operates operation device 200 to cause the illumination light to have a desired brightness. This user operation causes operation device 200 to transmit a dimming signal to controller 120 of illumination apparatus 100 via communication line 300, so that the brightness of illumination light emitted by light emitter 110 changes. In other words, the illuminance of illumination light from illumination apparatus 100 changes.

Operation device 200 may be, for example, a portable operation terminal such as a smartphone or a tablet PC, or operation equipment such as a controller attached to, for instance, the wall of a room.

Figure 2:
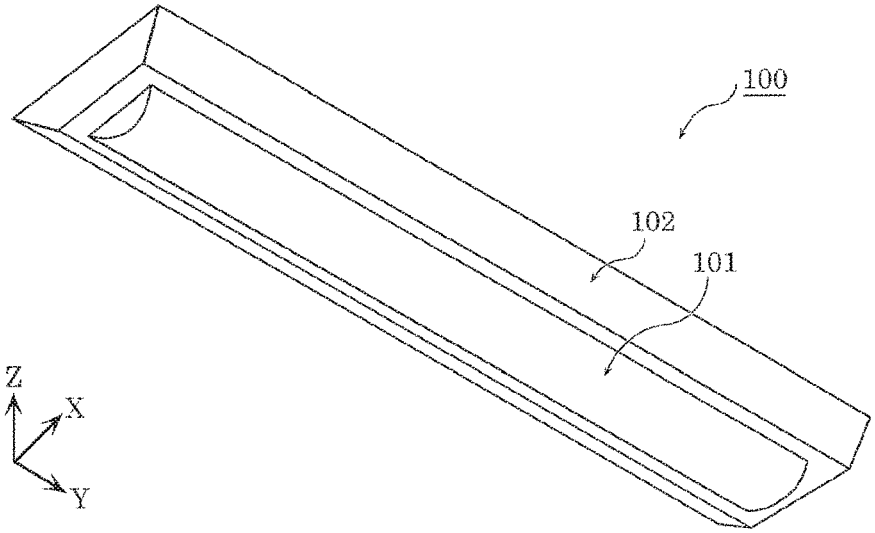
FIG. 2 is a perspective view of an illumination apparatus according to Embodiment 1.
Figure 3:
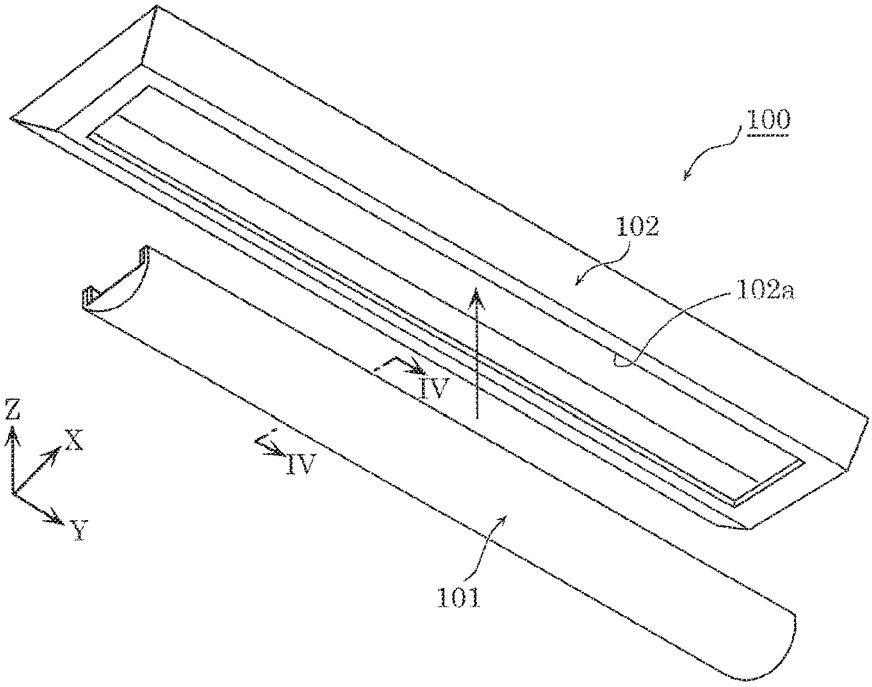
FIG. 3 is an exploded perspective view of the illumination apparatus according to Embodiment 1.

The following describes a specific configuration of illumination apparatus 100 for use in illumination control system 1 with reference to FIGS. 2 and 3. FIG. 2 is a perspective view of illumination apparatus 100 according to Embodiment 1. FIG. 3 is an exploded perspective view of illumination apparatus 100 as illustrated in FIG. 2.

Illumination apparatus 100 is a luminaire attached to a construction material such as a ceiling or a wall. In the present embodiment, illumination apparatus 100 is an elongated ceiling light, for example, and emits white light as illumination light.

As illustrated in FIGS. 2 and 3, illumination apparatus 100 includes light source unit 101 and device body 102. Light emitter 110 illustrated in FIG. 1 is configured as light source unit 101. Controller 120 is included in illumination apparatus 100.

Light source unit 101 emits white light using power supplied from a power supply. The power supply may be included in illumination apparatus 100, or may be disposed outside illumination apparatus 100. As illustrated in FIG. 3, light source unit 101 is fixed in opening 102*a* of device body 102.

Device body 102 is a holding member that holds light source unit 101, and is, for example, fixed to a ceiling with a hang bolt, for instance. Device body 102 is made of a metal plate, for example, and is formed into an elongated and flat box shape by, for instance, bending the metal plate. Elongated and quadrilateral opening 102*a* is provided in the undersurface of device body 102.

In the present embodiment, illumination apparatus 100 has, as light emitting modes, a display illuminating mode (first mode) in which light source unit 101 emits first illumination light, and a paper illuminating mode in which light source unit 101 emits second illumination light (second mode). The light emitting modes of illumination apparatus 100 can be switched by switching between the display illuminating mode and the paper illuminating mode. For example, the display illuminating mode and the paper illuminating mode can be switched by a user operating operation device 200. Note that controller 120 included in illumination apparatus 100 controls switching between the display illuminating mode and the paper illuminating mode, yet the present embodiment is not limited to this.

Figure 4:
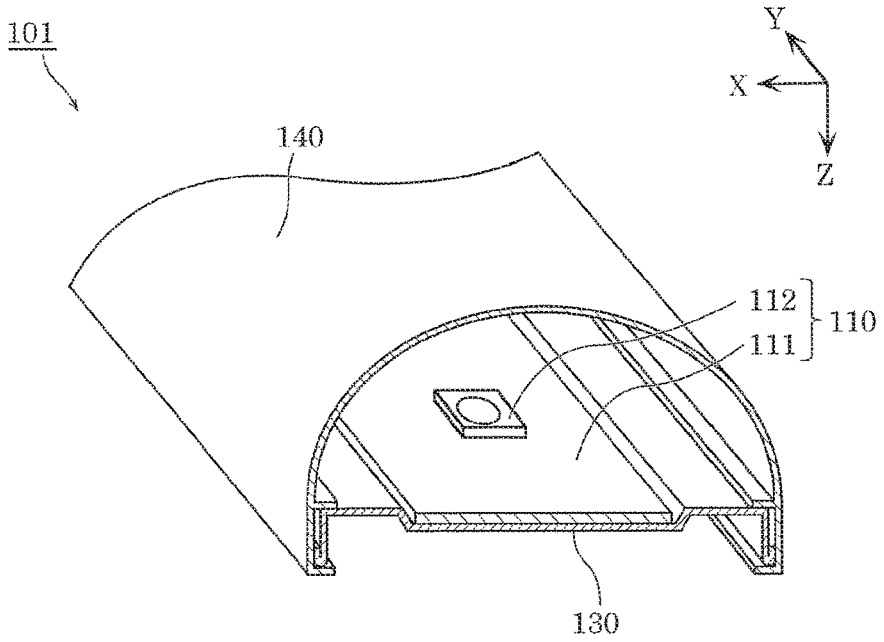
FIG. 4 is a cross-sectional perspective view of a light source unit in the illumination apparatus according to Embodiment 1.
Figure 5:
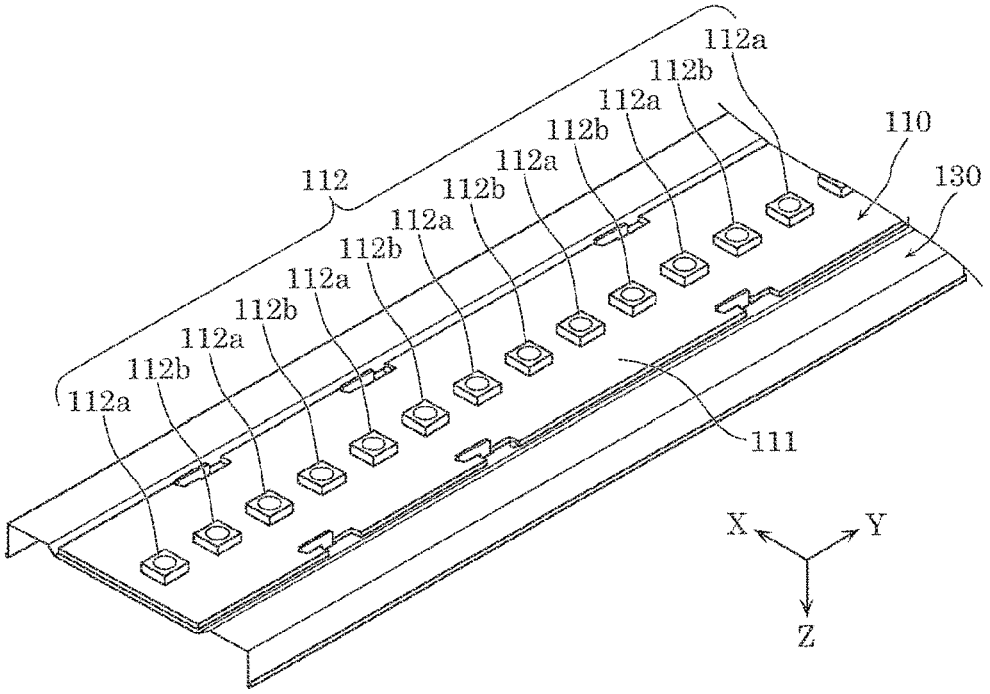
FIG. 5 is a perspective view when a light emitter side of the light source unit in the illumination apparatus according to an embodiment is viewed.

The following describes a detailed configuration of light source unit 101 with reference to FIGS. 4 and 5. FIG. 4 is a cross-section perspective view of light source unit 101 in illumination apparatus 100 according to Embodiment 1, and illustrates a cross section taken along line IV-IV in FIG. 3. FIG. 5 is a perspective view when the light emitter 110 side of light source unit 101 is viewed.

As illustrated in FIG. 4, light source unit 101 includes light emitter 110, base 130 which supports light emitter 110, and light-transmitting cover 140 which covers light emitter 110.

Light emitter 110 is a light source which includes one or more solid light emitting elements. Specifically, light emitter 110 is a light emitting diode (LED) module which includes one or more LEDs as the one or more solid light emitting elements, and emits white light as illumination light. Light emitter 110 is attached to base 130.

As illustrated in FIGS. 4 and 5, light emitter 110 includes substrate 111 and LED elements 112 disposed on substrate 111. Light emitter 1 in the present embodiment is a surface mount device (SMD) light emitting module, and LED elements 112 are mounted on substrate 111.

Substrate 111 is a mounting substrate for mounting LED elements 112. Substrate 111 is an elongated quadrilateral substrate, and is, for example, a resin substrate, a metal base substrate, or a ceramic substrate, for example. Substrate 111 is placed on and fixed to base 130.

For example, plural LED elements 112 are linearly mounted on substrate 111, at predetermined spacings in the longitudinal direction of substrate 111.

In the present embodiment, each LED element 112 is an SMD light emitting element, and includes a container (package) made of, for instance, resin, an LED chip (bare chip) disposed in the container, and a sealant which seals the LED chip.

Each LED element 112 is a white LED light source which emits white light. For example, a blue LED chip which emits blue light upon being energized is used as the LED chip, and a silicone resin (phosphor containing resin) which includes a yellow phosphor and a red phosphor is used as the sealant with which the container is filled.

As illustrated in FIG. 5, plural LED elements 112 include first LED elements 112*a*, and second LED elements 112*b* which emit light having a lower color temperature than the color temperature of light emitted by first LED elements 112*a*. In the present embodiment, first LED element 112*a* and second LED element 112*b* are alternately disposed one by one, yet the order in which first LED elements 112*a* and second LED elements 112*b* are disposed and how many of first LED elements 112*a* and second LED elements 112*b* are disposed alternately are not limited to the above.

First LED element 112*a* is a white LED light source which emits white light having a correlated color temperature in a range from 5000 K to 7200 K, whereas second LED element 112*b* is a white LED light source which emits white light having a correlated color temperature in a range from 2700 K to 3800 K.

Figure 6:
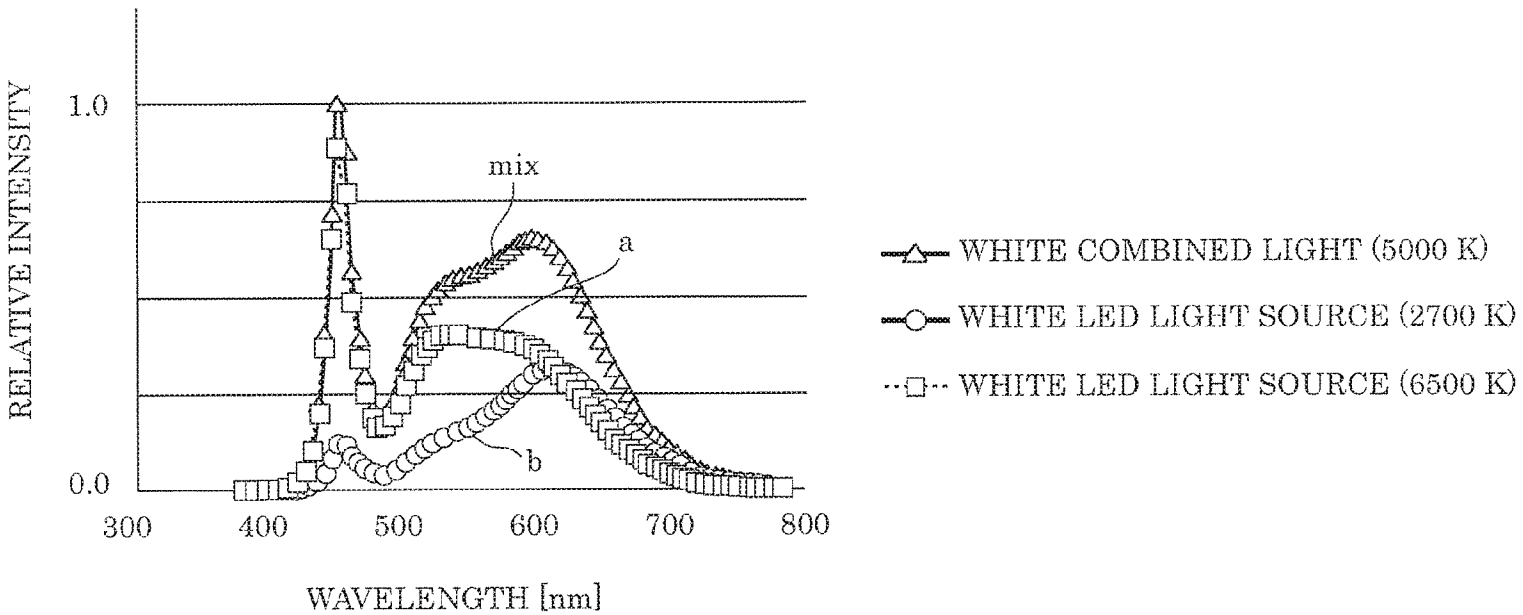
FIG. 6 illustrates a spectral distribution of light emitted by the light emitter and light emitting diode (LED) elements in the illumination apparatus according to the embodiment.

In the present embodiment, first LED element 112*a* emits light having a correlated color temperature of 6500 K, and spectral distribution a illustrated in FIG. 6. Second LED element 112*b* emits light having a correlated color temperature of 2700 K, and spectral distribution b illustrated in FIG. 6. In this case, if first LED element 112*a* and second LED element 112*b* emit light, light emitter 110 achieves a correlated color temperature of 5000 K, and emits light having spectral distribution mix illustrated in FIG. 6.

Light emitter 110 is configured to be color-tuning controllable, and a color temperature of light from light emitter 110 can be changed. For example, the color of light from light emitter 110 can be tuned within a range in correlated color temperature from 2700 K to 6500 K by dimming first LED element 112*a* and second LED element 112*b*. Note that the color of light from light emitter 110 can be tuned within a range in correlated color temperature from 2700 K to 7200 K by setting a correlated color temperature of light from first LED element 112*a* to 7200 K.

Light emitter 110 emits first illumination light as illumination light for illuminating a display. The first illumination light has a correlated color temperature in a range from 4000 K to 5800 K, and u'v' chromaticity coordinates in an XYZ colorimetric system in a range which satisfies $0.7125u'+0.3284<v'<0.7125u'+0.3339$.

Light emitter 110 emits second illumination light as illumination light for illuminating paper suitable for viewing text on paper or reading and writing text on paper. The second illumination light has optical characteristics which include: a correlated color temperature in a range from 5400 K to 7000 K; color deviation Duv in a range from −6 to 8; and a chroma value of at most 2.0, the chroma value being obtained using the calculation method specified in the CIE 1997 Interim Color Appearance Model (Simple Version).

Light emitter 110 having such a configuration is attached to base 130. Specifically, substrate 111 of light emitter 110 is fixed to base 130. Base 130 is an elongated metal casing, and can be formed by, for instance, bending a metal plate such as a cold rolled steel plate (steel plate cold commercial (SPCC)), for example.

As illustrated in FIG. 4, light emitter 110 attached to base 130 is covered by light-transmitting cover 140. Light-transmitting cover 140 is a light-transmitting cover member which transmits light from light emitter 110 (LED elements 112). Light-transmitting cover 140 has an elongated, substantially semi-cylindrical shape, for example.

Light-transmitting cover 140 includes a light-transmitting resin material such as acrylic or polycarbonate, or a light-transmitting material such as a glass material, for example.

Light-transmitting cover 140 may further have light diffusibility (light scattering properties). Specifically, light-transmitting cover 140 may be a diffusive cover which has light transmissibility and light diffusibility, rather than a transparent cover. Light from strongly directive LED elements 112 can be scattered by giving light diffusibility to light-transmitting cover 140, and thus spotty lighting (poor luminance uniformity) due to a difference in brightness of light emitted from plural LED elements 112 can be inhibited.

Here, the following describes in detail optical characteristics of illumination light emitted by illumination apparatus 100, also mentioning the circumstances which led to the present disclosure.

Examinations on ambient light that allows text on paper to be readily read by making the paper appear whiter have been made so far, yet no optimal ambient light for text on a display has been recommended, and thus it is difficult to obtain ambient light that allows text on a display to be readily read, with a conventional illumination apparatus.

In addition, a display has a function for a user to manually adjust the brightness and contrast of a screen, yet the user does not know what conditions are suitable for ambient light. Thus, the display setting (screen setting) of the display is often maintained in the initial state.

In view of this, the inventors of the present application examined an illumination apparatus which emits illumination light which can improve readability of text displayed on a screen of a display by improving visibility of the text.

Figure 7:
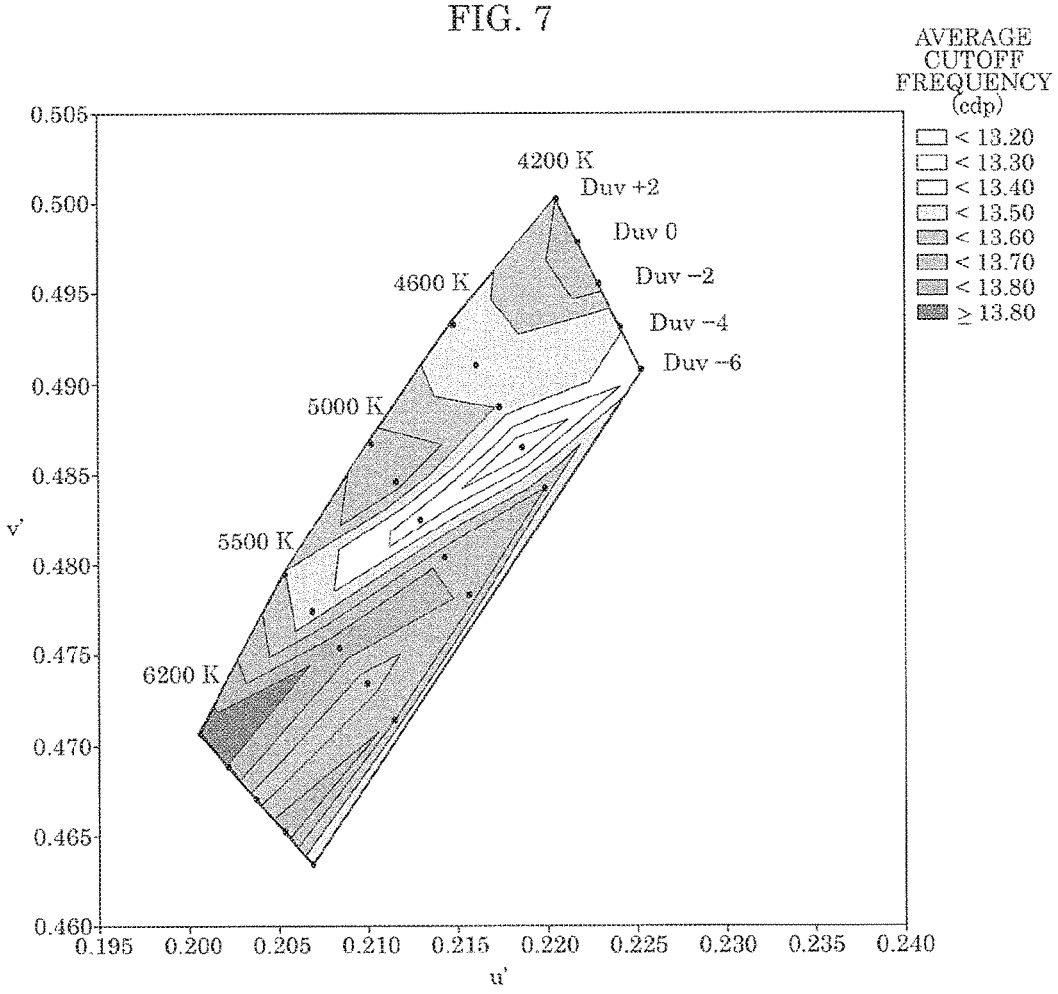
FIG. 7 illustrates evaluation of visibility of text on a display based on space cut-off frequencies.

Specifically, the inventors of the present application conducted an experiment to evaluate the visibility of text displayed on a display under different-color illumination obtained by changing the color of illumination light emitted from the illumination apparatus and serving as ambient light for the display. FIG. 7 illustrates results of the experiment.

In the experiment, visibility of text displayed on the display was evaluated using space cutoff frequencies. In FIG. 7, evaluation of visibility of text under different-color illumination according to 25 conditions is illustrated in a contour map having contours through average cutoff frequencies (cdp) in a u'v' chromaticity diagram.

Specifically, evaluations were made for light colors according to a total of 25 conditions, that is, correlated color temperatures at five levels (4200 K, 4600 K, 5000 K, 5500 K, and 6200 K) and color deviations (Duv) at five levels (2, 0, −2, −4, and −6).

In the experiment, under different-color illumination light according to 25 conditions, a cutoff frequency is changed by performing low-pass-filter processing on text displayed on the display, and resolution of the text displayed on the display was changed. At this time, the inventors had 15 subjects (aged 25 to 54) to answer up to which cutoff frequency the text appeared clearly.

For the light colors according to the 25 conditions, FIG. 7 was obtained by plotting the averages of cutoff frequencies for the 15 subjects when the text on the display appeared clearly, on the u'v' chromaticity diagram in the XYZ color system.

Note that the display used in this experiment is a 23-inch liquid crystal display having a screen aspect ratio of 16:9 and a screen intensity of 180 cd/m$^2$.

Here, a relation between a cutoff frequency and visibility of text shows that even text having low resolution appears more clearly with a light color obtained when a cutoff frequency is lower. In other words, a lower cutoff frequency achieves a light color which provides higher visibility of text.

Thus, the experiment showed that visibility of text on a display is the highest when illumination light has a correlated color temperature of 4600 K and Duv at or near a chromaticity point of −4, as illustrated in FIG. 7.

As can be seen from FIG. 7, not only a correlated color temperature, but also Duv influences the visibility of text on a display. Specifically, it can be seen that optimal Duv for visibility of text changes for each correlated color temperature.

Regarding this point, the experiment shows that light colors for optimal Duv for text visibility are achieved in the cases where Duv is −6 when a correlated color temperature is 4200 K, Duv is −4 when a correlated color temperature is 4600 K, Duv is −2 when a correlated color temperature is 5000 K, and Duv is 0 when a correlated color temperature is 5500 K, except the case where a correlated color temperature is 6200 K. Thus, the experiment shows that optimal Duv for text visibility increases with an increase in a correlated color temperature.

Figure 8:
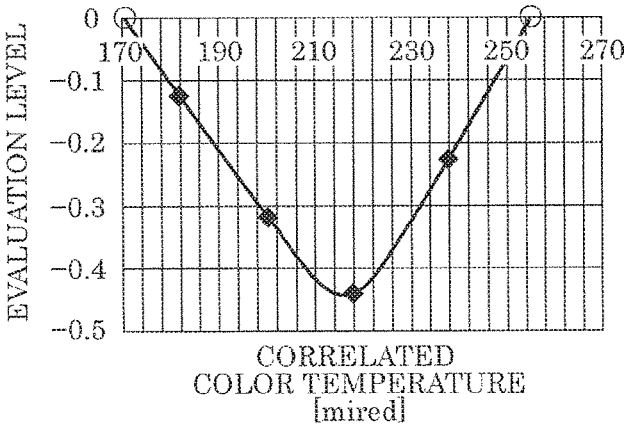
FIG. 8 illustrates a correlated color temperature of light which provides good visibility of text on a display.

In view of this, assuming that difference values from the average cutoff frequencies under all the light color conditions of the subjects at optimal Duvs for correlated color temperatures are evaluation levels, FIG. 8 illustrates this relation. Stated differently, FIG. 8 illustrates, as evaluation levels, averages of values for all the subjects which are obtained by subtracting average cutoff frequencies under all the light color conditions from cutoff frequencies at optimal Duvs for correlated color temperatures at four levels (4200 K, 4600 K, 5000 K, and 5500 K), excluding 6200 K.

In this case, a correlated color temperature for which an evaluation level is less than zero in FIG. 8 provides higher visibility of text on a display than other light color conditions. Note that in FIG. 8, the unit of correlated color temperature is shown as "micro reciprocal degree (mired)", rather than "kelvin (K)".

In FIG. 8, curve approximation is performed based on the evaluation levels for the four levels of the correlated color temperatures, and the intersections between the curve and the evaluation level 0 are calculated to be 172 mireds and 250 mireds. Accordingly, the result illustrated in FIG. 8 shows that visibility of text on a display increases in a range in correlated color temperature from 172 mireds to 250 mireds (that is, a range from 4000 K to 5800 K).

Figure 9:
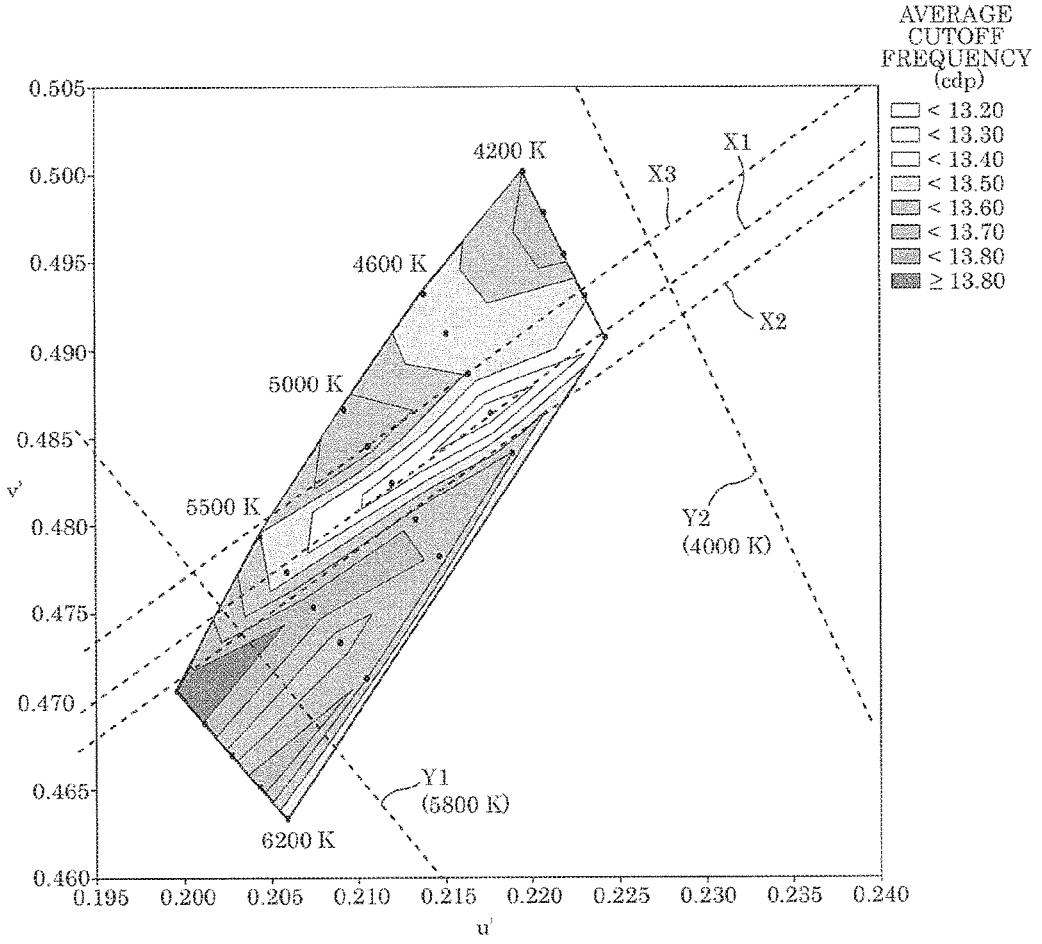
FIG. 9 illustrates a region which includes a light color which provides high visibility of text on a display.

A summary of the above analysis shows that a light color which provides high visibility of text on a display is included in a region surrounded by straight lines X2, X3, Y1, and Y2 (a displayed text highly visible area) in FIG. 9. FIG. 9 illustrates a region which includes a light color which provides high visibility of text on a display in FIG. 7.

Here, in FIG. 9, straight line X1 indicates an approximate line which connects points of optimal Duv for text visibility of correlated color temperatures at u'v' chromaticity coordinates in the XYZ colorimetric system, and can be indicated by (Expression 1) below.

$$\text{Straight line } X1: v' = 0.7125u' + 0.3305 \quad \text{(Expression 1)}$$

Straight lines X2 and X3 are parallel lines obtained by translating straight line X1 in parallel, and are two straight lines in contact with a range in which cutoff frequency fc which is an average for all the light color conditions is lower than 13.50 (fc<13.50). Specifically, straight lines X2 and X3 are boundary lines which indicate the mean value (average) of cutoff frequencies evaluated in the experiment. In this case, straight line X2 can be expressed by (Expression 2) below, and straight line X3 can be expressed by (Expression 3) below.

$$\text{Straight line } X2: v' = 0.7125u' + 0.3284 \quad \text{(Expression 2)}$$

$$\text{Straight line } X3: v' = 0.7125u' + 0.3339 \quad \text{(Expression 3)}$$

In FIG. 9, straight lines Y1 and Y2 indicate the lower limit (4000 K) and the upper limit (5800 K) of a correlated color temperature which provides high text visibility in FIG. 8.

As can be seen from the above examinations, illumination light having a correlated color temperature in a range from 4000 K to 5800 K and u'v' chromaticity coordinates in the XYZ colorimetric system in a range which satisfies 0.7125u'+0.3284<v'<0.7125u'+0.3339 has high visibility of text on a display. Illumination apparatus 100 according to the present embodiment causes light emitter 110 to emit first illumination light as illumination light for illuminating a display in the display illuminating mode.

Specifically, illumination apparatus 100 in FIG. 1 causes light emitter 110 to emit, as illumination light for illuminating a display, first illumination light having a correlated color temperature in a range from 4000 K to 5800 K and u'v' chromaticity coordinates in the XYZ colorimetric system in a range which satisfies 0.7125u'+0.3284<v'<0.7125u'+0.3339, whereby visibility of text on the display can be improved. In particular, even if the display setting of the display is maintained in the initial state, visibility of text on the display can be readily improved.

This improves readability of text on a display, and achieves a comfortable illumination space that gives a user no odd feeling when the user works on a visual task.

In the present embodiment, in the paper illuminating mode, light emitter 110 emits second illumination light as illumination light for illuminating paper. The second illumination light has optical characteristics which include: a correlated color temperature in a range from 5400 K to 7000 K, color deviation Duv in a range from −6 to 8, and a chroma value of at most 2.0, the chroma value being obtained using the calculation method specified in the CIE 1997 Interim Color Appearance Model (Simple Version).

Accordingly, when it is not necessary to view text on a display, by switching the mode of illumination apparatus 100 to the paper illuminating mode, illumination apparatus 100 emits illumination light (second illumination light) more suitable to read text on paper than the first illumination light.

Note that in the present embodiment, the desk surface illuminance (horizontal illuminance) of illumination light emitted by illumination apparatus 100 may be at most 1000 lx. If the desk surface illuminance exceeds 1000 lx, the brightness is too high so that text on a display may be invisible due to blown-out highlights.

Embodiment 2

Embodiment 1 above has described the color range of illumination light suitable for improving visibility of text on a display, yet the inventors of the present application have taken notice of influence exerted by outdoor light, such as natural light, on the visibility of text on a display, and found technology which improves the visibility of text on a display also in the case where not only illumination light, but also outdoor light falls on the display.

For example, considering a display placed in a room, natural light such as sunlight which enters through, for instance, a window falls on a display. At this time, a color temperature of natural light such as sunlight changes depending on a time period, and thus the light color of a display on which natural light falls changes not only due to ambient light (illumination light) emitted by an illumination apparatus, but also due to the natural light. As a result, how text on the display appears changes depending on a time period under the influence of the natural light.

In view of this, as a result of diligent examinations, the inventors of the present application have found technology which increases the visibility of text irrespective of a time period and with the display setting of a display in the initial state, by changing illumination light in an opposite direction of a direction in which the color temperature of natural light changes, in accordance with a change in color temperature of the natural light depending on a difference according to time periods, and emitting the resultant illumination light onto the display.

Figure 10:
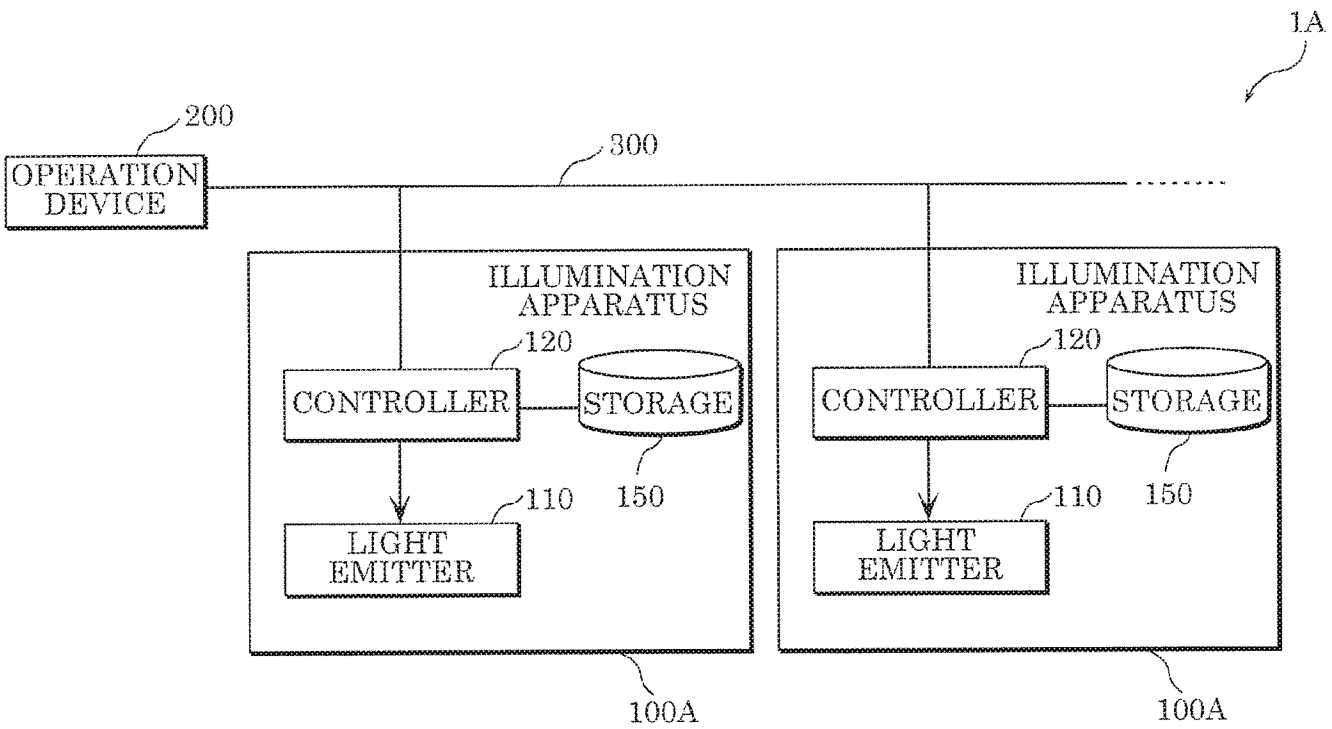
FIG. 10 illustrates a functional configuration of an illumination control system according to Embodiment 2.

The following describes the technology as Embodiment 2 with reference to FIG. 10. FIG. 10 illustrates a functional configuration of illumination control system 1A according to Embodiment 2.

Illumination control system 1A according to the present embodiment is different from illumination control system 1 according to Embodiment 1 described above, in the configuration of illumination apparatus 100A. Specifically, illumination apparatus 100A according to the present embodiment is different from illumination apparatus 100 according to Embodiment 1 described above in that storage 150 which has stored therein color tuning control schedule information for performing color tuning control of illumination light according to time is included, and controller 120 controls light emitter 110 according to the color tuning control schedule information.

Figure 11:
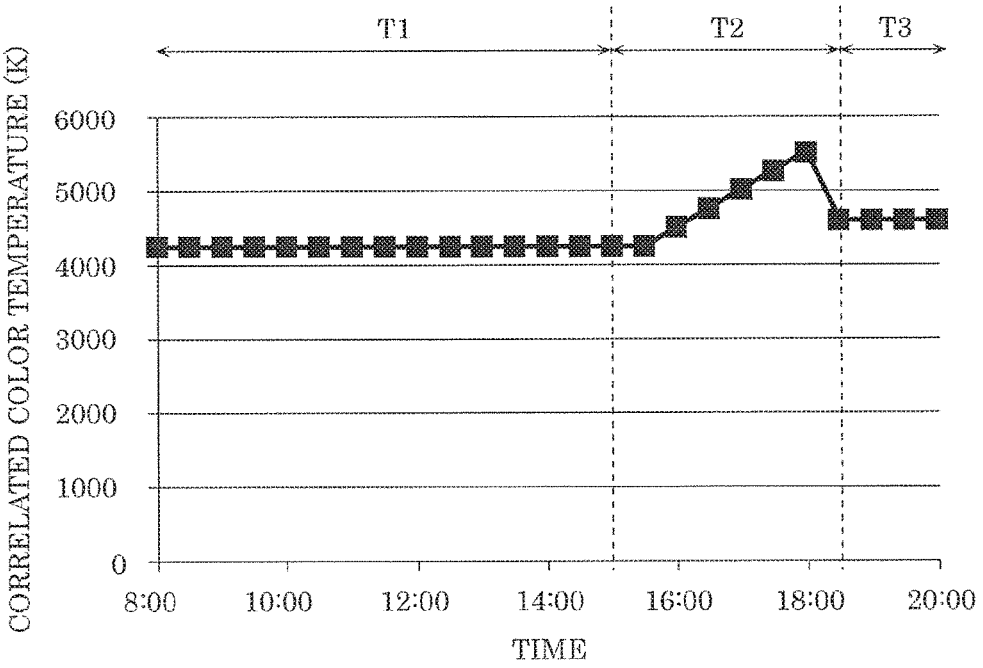
FIG. 11 illustrates an example of color tuning control schedule information in the illumination control system according to Embodiment 2.

The color tuning control schedule information stored in storage 150 is data which indicates correlated color temperatures of illumination light (first illumination light) which light emitter 110 emits at predetermined times in the display illuminating mode. As an example, color tuning control schedule information is the data illustrated in FIG. 11. Note that FIG. 11 illustrates, as examples, relations between a correlated color temperature and times for 12 hours from 8:00 a.m. to 8:00 p.m. In FIG. 11, a correlated color temperature is set for every 30 minutes, yet the present embodiment is not limited thereto. The correlated color temperature may be set per minute or for every 10 minutes, for instance, or may be set per hour.

Such color tuning control schedule information can be created by operation device 200. For example, the color tuning control schedule information can be created according to a user operation on operation device 200. The created color tuning control schedule information is transmitted by operation device 200 to controller 120 of illumination apparatus 100A.

Controller 120 stores the received schedule information into storage 150. Controller 120 includes a clock which measures a current time, and controls color tuning of light emitter 110 for every predetermined time based on the color tuning control schedule information.

Specifically, according to the color tuning control schedule information, controller 120 controls light emitter 110 to cause illumination light emitted by light emitter 110 to have a correlated color temperature for the time.

In the present embodiment, as illustrated in FIG. 11, controller 120 controls light emitter 110 during first time period T1 from a predetermined time in the morning to around 3:00 p.m. to cause illumination light emitted by light emitter 110 to have a constant correlated color temperature in a range from 4000 K to 5000 K.

Specifically, the predetermined time at which color tuning control starts is 8:00 a.m., and during first time period T1 from 8:00 a.m. to around 3:00 p.m., the color of illumination light emitted by light emitter 110 is constantly maintained to have 4200 K.

Accordingly, light emitter 110 is controlled to keep the color temperature of illumination light emitted by light emitter 110 low, since the color temperature of sunlight is high during first time period T1 from 8:00 a.m. to around 3:00 p.m.

Specifically, at around 9:00 a.m. and around 3:00 p.m., the solar altitude is substantially the same, and thus the color temperature of natural light is also substantially the same and comparatively high. In view of this, during the time period when the color temperature of natural light is comparatively high, illumination light having a low correlated color temperature is emitted near a display. Accordingly, illumination light emitted by light emitter 110 and natural light can cause the light at and near the display to have a correlated color temperature of 4600 K and Duv near the chromaticity point of −4.

Note that in the present embodiment, a control start time of first time period T1 is 8:00 a.m., yet the present embodiment is not limited to this. For example, when illumination apparatus 100A is used in an office, the control start time can be set to the work start time (for example, 9:00 a.m.).

Controller 120 controls light emitter 110 during second time period T2 from around 15:00 p.m. to sunset to cause illumination light emitted by light emitter 110 to have a correlated color temperature that increases as time elapses in a range from 5000 K to 5800 K.

Specifically, during second time period T2 from around 15:00 p.m. to sunset, a correlated color temperature of the color of illumination light emitted by light emitter 110 is linearly changed from 4200 K to 5600 K as time elapses.

Accordingly, during second time period T2 from 3:00 p.m. to sunset, the color temperature of sunlight gradually decreases as the time elapses, and thus light emitter 110 is controlled so that the color temperature of illumination light emitted by light emitter 110 gradually increases.

Specifically, the color temperature of natural light falls from evening after 3:00 p.m. until sunset, due to a decrease in the solar altitude. In view of this, during the time period in which the color temperature of natural light comparatively decreases, illumination light is emitted near a display with the correlated color temperature of the illumination light being increased. Accordingly, illumination light emitted by light emitter 110 and natural light can cause the light at and near the display to have a correlated color temperature of 4600 K and Duv at or near the chromaticity point of −4.

Controller 120 controls light emitter 110 during third time period T3 from sunset to a predetermined time in the night to cause illumination light emitted by light emitter 110 to have a constant light color in a range from 4000 K to 5000 K.

Specifically, during third time period T3 from sunset to 8:00 p.m., the color of illumination light emitted by light emitter 110 is constantly set to 4600 K.

Accordingly, during third time period T3 after sunset, sunlight does not enter through a window, and thus light emitter 110 is controlled to make the color temperature of illumination light emitted by light emitter 110 suitable for visibility of text on a display.

Specifically, it is not necessary to take the influence of sunlight into consideration after sunset, and only the illumination light is taken into consideration to set the correlated color temperature of illumination light so as to provide an optimal light color for the visibility of text on a display. Specifically, the light at and near a display may be caused to have a correlated color temperature of 4600 K and Duv at or near the chromaticity point of −4.

Accordingly, controller 120 performs timer control for carrying out predetermined color tuning control at a time set based on the color tuning control schedule information. In this case, color tuning of light emitter 110 may be controlled using a timer which has input sunset and sunrise time information. For example, the sunset set time may be manually set per week or may be automatically set by being obtained from the Internet, for instance.

An output table in which a correlated color temperature and a current supplied to LED elements included in light emitter 110 are associated may be prestored in storage 150 in order that controller 120 controls color tuning of light emitter 110, based on the color tuning control schedule information. Accordingly, color tuning of light emitter 110 can be readily controlled by supplying the LED elements with a current having a value for a correlated color temperature set in the color tuning control schedule information.

Note that in the present embodiment, the location where illumination apparatus 100A is placed is an office, yet the location is not limited thereto, and may be a workplace such as a work area.

As described above, illumination apparatus 100A according to the present embodiment changes illumination light emitted by light emitter 110 in an opposite direction of a direction in which a color temperature of natural light changes in accordance with a change in color temperature of natural light (such as sunlight) depending on a difference according to time periods, and emits the resultant illumination light onto a display.

Specifically, as in Embodiment 1 above, when a user works on a visual task to view text on a display in a light environment in which there is no influence of natural light and only illumination light influences the visibility of the text on the display, the color of illumination light emitted by light emitter 110 may be controlled such that the light color is always within the region surrounded by the four straight lines in FIG. 9 (the displayed text highly visible area).

On the other hand, in the case where outdoor light such as natural light (sunlight) falls on a display as in the present embodiment, how text on the display appears changes depending on a time period. In view of this, in the present embodiment, illumination light emitted by light emitter 110 is changed according to a change in color temperature of natural light due to a difference according to a time period.

Specifically, during first time period T1 from a predetermined time in the morning to around 3:00 p.m., light emitter 110 is controlled to cause illumination light emitted by light emitter 110 to have a constant correlated color temperature in a range from 4000 K to 5000 K. During second time period T2 from around 3:00 p.m. to sunset, light emitter 110 is controlled to cause illumination light emitted by light emitter 110 to have a correlated color temperature that increases as time elapses in a range from 5000 K to 5800 K. During third time period T3 from sunset to a predetermined time in the night, light emitter 110 is controlled to cause illumination light emitted by light emitter 110 to have a constant light color in a range from 4000 K to 5000 K.

Accordingly, even in the case where outdoor light (such as natural light) which has a color temperature that changes depending on a time period falls on a display, visibility of text on the display can be improved irrespective of the time period. In particular, even if the display setting of the display is maintained in the initial state, visibility of text on the display can be readily improved.

Note that in the present embodiment, color tuning control schedule information is created via operation device 200, yet the present embodiment is not limited thereto. For example, color tuning control schedule information may be created via, for instance, another terminal other than operation device 200, or may be prestored in storage 150 of illumination apparatus 100A. In this case, the color tuning control schedule information stored in storage 150 can be changed via operation device 200.

Variation 1 of Embodiment 2

Figure 12:
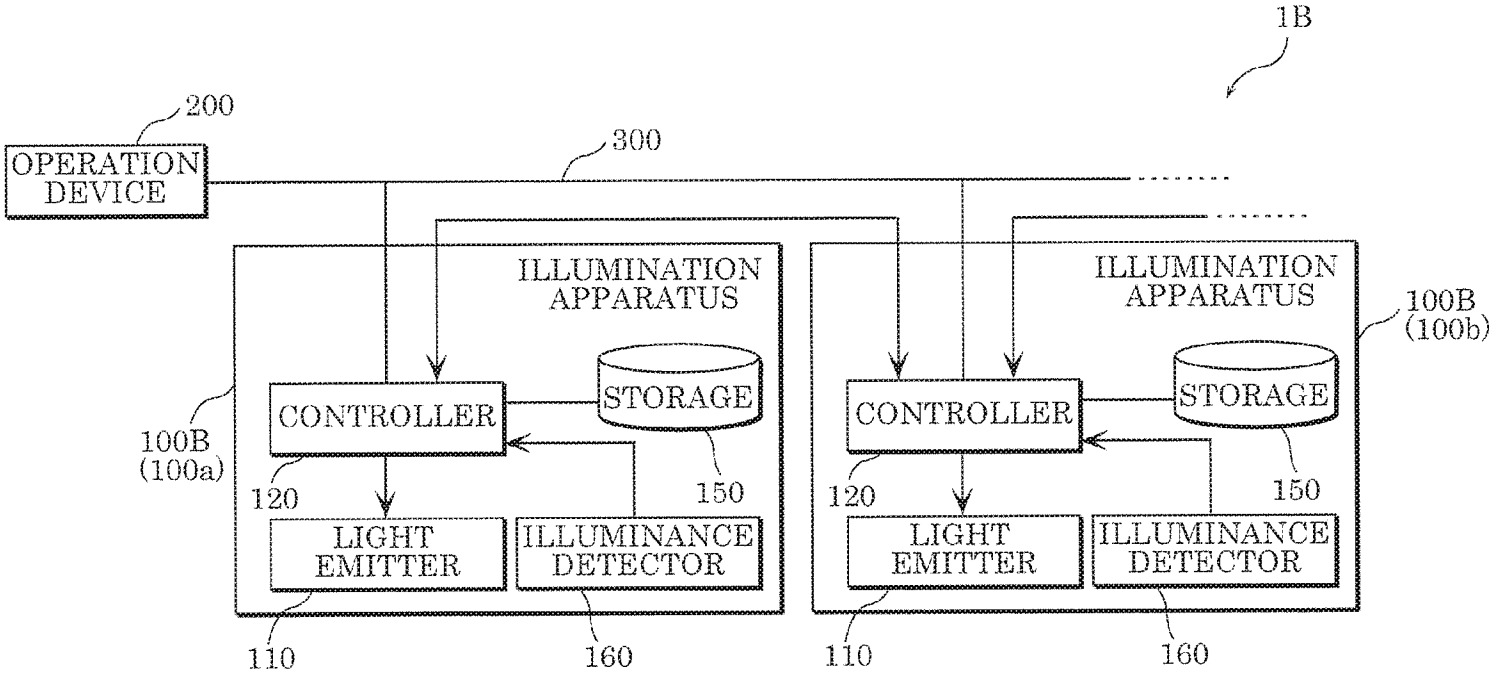
FIG. 12 illustrates a functional configuration of an illumination control system according to Variation 1 of Embodiment 2.

The following describes Variation 1 of Embodiment 2 with reference to FIG. 12. FIG. 12 illustrates a functional configuration of illumination control system 1B according to Variation 1 of Embodiment 2.

As illustrated in FIG. 12, illumination control system 1B according to this variation is different from illumination control system 1A according to Embodiment 2 described above, in the configuration of illumination apparatus 100B. Thus, illumination apparatus 100B according to this variation is different from illumination apparatus 100A according to Embodiment 2 described above in that illuminance detector 160 is further included.

Illuminance detector 160 of each illumination apparatus 100B detects the illuminance in a predetermined space which outdoor light such as natural light (such as sunlight) enters. For example, illuminance detector 160 detects a horizontal illuminance in a predetermined region in the office, for instance (for example, the surface of a desk which is present near a display used in an illumination area of each illumination apparatus 100B). Illuminance detector 160 outputs the detected illuminance to controller 120.

In the present embodiment, light emitters 110 of plural illumination apparatuses 100B disposed in different locations are controlled using the results of detection by illuminance detectors 160 to cause horizontal illuminances of illumination light emitted by illumination apparatuses 100B match.

For example, when among plural illumination apparatuses 100B, illumination apparatus 100B disposed in a location is first illumination apparatus 100*a* and illumination apparatus 100B disposed in another location is second illumination apparatus 100*b* (different from first illumination apparatus 100*a*), controller 120 included in first illumination apparatus 100*a* changes the output of illumination light emitted by light emitter 110 included in first illumination apparatus 100*a*, to cause the illuminance in the predetermined space detected by illuminance detector 160 included in first illumination apparatus 100*a* to match the illuminance in the predetermined space detected by illuminance detector 160 included in second illumination apparatus 100*b*, first illumination apparatus 100*a* and second illumination apparatus 100*b* being included in plural illumination apparatuses 100B. Note that the result of detection by illuminance detector 160 of first illumination apparatus 100*a* and the result of detection by illuminance detector 160 of second illumination apparatus 100*b* can be transmitted to and received by respective controllers 120.

Accordingly, even in the case where the horizontal illuminances near displays disposed in different locations are different due to outdoor light entering the predetermined space, text visibility can be improved, irrespective of the positions of the displays.

For example, the horizontal illuminance near a display disposed in a position close to a window is higher than the horizontal illuminance near a display disposed in a position away from the window, and thus in this case, light output of light emitter 110 of illumination apparatus 100B disposed near the display in the position close to the window is decreased. Accordingly, the horizontal illuminance of illumination light emitted by illumination apparatus 100B disposed near the display in the position close to the window and the horizontal illuminance of illumination light emitted by illumination apparatus 100B disposed near the display in the position away from the window can be matched. Thus, text visibility can be improved also for the display disposed in the position close to the window.

Note that illuminance detector 160 is included in illumination apparatus 100B in this variation, yet this variation is not limited thereto and illuminance detector 160 may be independent from illumination apparatus 100B. For example, illuminance detector 160 may be disposed in the upper portion of a display, for instance.

Variation 2 of Embodiment 2

Figure 13:
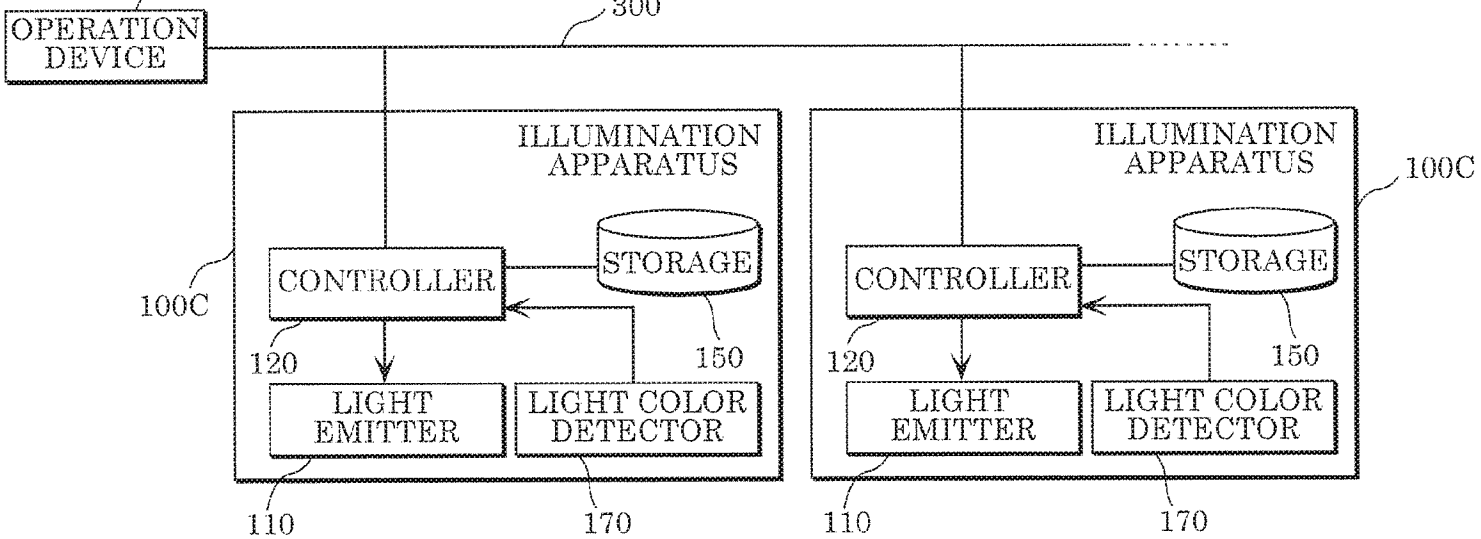
FIG. 13 illustrates a functional configuration of an illumination control system according to Variation 2 of Embodiment 2.

The following describes Variation 2 of Embodiment 2 with reference to FIG. 13. FIG. 13 illustrates a functional configuration of illumination control system 1C according to Variation 2 of Embodiment 2.

As illustrated in FIG. 13, illumination control system 1C according to this variation is different from illumination control system 1A according to Embodiment 2 described above, in the configuration of illumination apparatus 100C. Specifically, illumination apparatus 100C according to this variation is different from illumination apparatus 100A according to Embodiment 2 described above in that light color detector 170 is further included.

Each light color detector 170 detects a light color in a predetermined space which outdoor light such as natural light (such as sunlight) enters. For example, light color detector 170 detects a light color (correlated color temperature, Duv) in a predetermined region in an office, for instance (for example, the surface of a desk present near a display used in an illumination area of each illumination apparatus 100C). Light color detector 170 outputs the detected light color to controller 120.

Controller 120 controls light emitter 110 based on the light color in the predetermined space detected by light color detector 170, to cause illumination light emitted by light emitter 110 to have a light color according to predetermined color tuning control schedule information.

For example, controller 120 controls light emitter 110 to cause the result of detection by light color detector 170 to show that light emitter 110 is emitting illumination light having a color set in the color tuning control schedule information as illustrated in FIG. 11.

Accordingly, even in the case where outdoor light enters the predetermined space, the color of illumination light from light emitter 110 can be readily adjusted to a light color according to the color tuning control schedule information, by changing the color of the illumination light.

Note that in this variation, light color detector 170 is included in illumination apparatus 100C, yet this variation is not limited thereto, and light color detector 170 may be independent from illumination apparatus 100C. For example, light color detector 170 may be disposed in the upper portion of a display, for instance.

Variations

In Embodiments 1 and 2 and the variations thereof described above, first illumination light having the above optical characteristics is achieved using two types of white LED light sources as LED elements 112, namely white LED light sources which emit white light having a correlated color temperature of 6500 K and white LED light sources which emit white light having a correlated color temperature of 2700 K, yet the present disclosure is not limited thereto. The following describes other aspects of LED elements 112 for achieving the first illumination light having the above optical characteristics.

Variation 1

In this variation, the first illumination light having the above optical characteristics is achieved using, as LED elements 112, white LED light sources which emit white light having a correlated color temperature in a range from 5000 K to 7200 K, and red LED light sources which emit red light having a main peak wavelength in a range from 600 nm to 650 nm.

Figure 14:
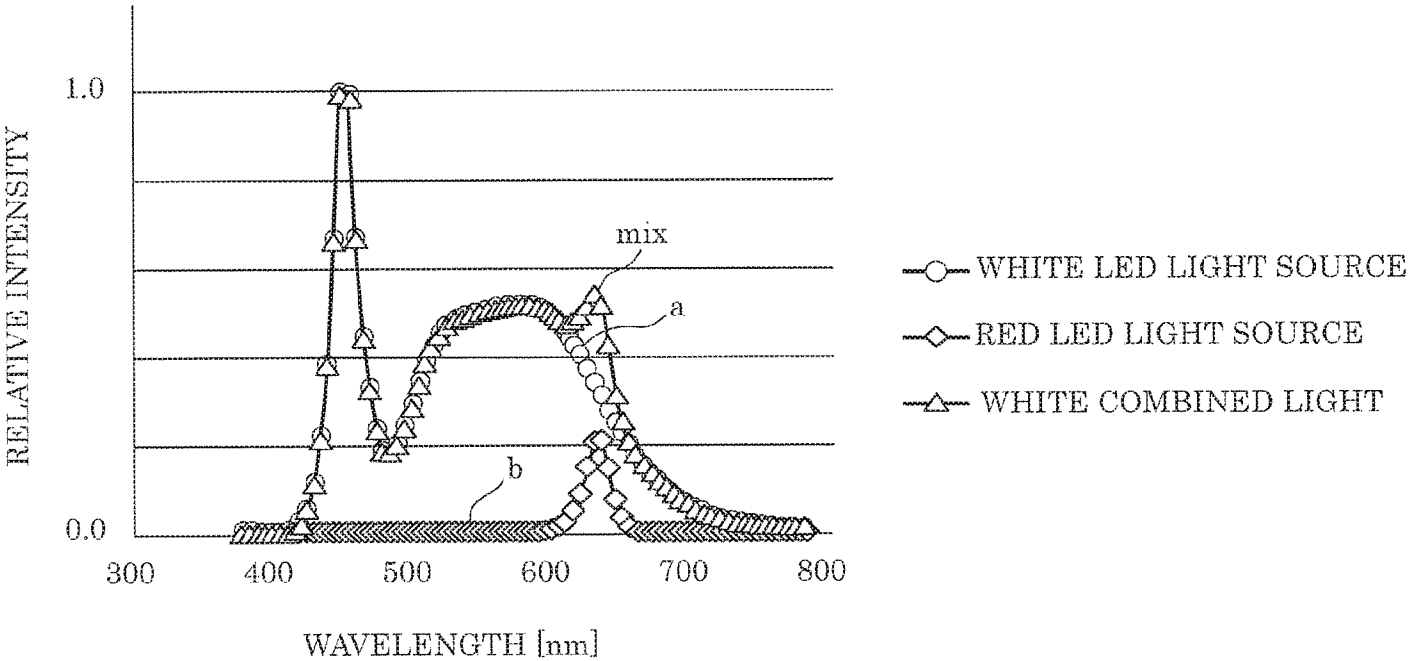
FIG. 14 illustrates a spectral distribution of light emitted by a light emitter and LED elements in the illumination apparatus according to Variation 1.

In this case, in Embodiments 1 and 2 and the variations thereof described above, the white LED light sources may be used as first LED elements 112*a*, and the red LED light sources may be used as second LED elements 112*b*. At this time, first LED elements 112*a* (white LED light sources) emit light having spectral distribution a illustrated in FIG. 14, and second LED elements 112*b* (red LED light sources) emit light having spectral distribution b illustrated in FIG. 14. If all first LED elements 112*a* and all second LED elements 112*b* emit light, light emitter 110 emits light having spectral distribution mix illustrated in FIG. 14.

Accordingly, existing white LED light sources having a correlated color temperature of at least 5000 K and red LED light sources are combined to achieve the first illumination light, whereby existing light and the first illumination light can be efficiently switched, in addition to improvement in the visibility of text on a display. Note that red LED light sources having a main peak wavelength in a range from 620 nm to 640 nm may be used as second LED elements 112*b*.

Variation 2

In this variation, as LED elements 112, white LED light sources which emit white light having a correlated color temperature in a range from 5000 K to 7200 K, white LED light sources which emit white light having a correlated color temperature in a range from 2700 K to 3800 K, and red LED light sources which emit red light having a main peak wavelength in a range from 600 nm to 650 nm are used to achieve the first illumination light having the above optical characteristics.

Figure 15:
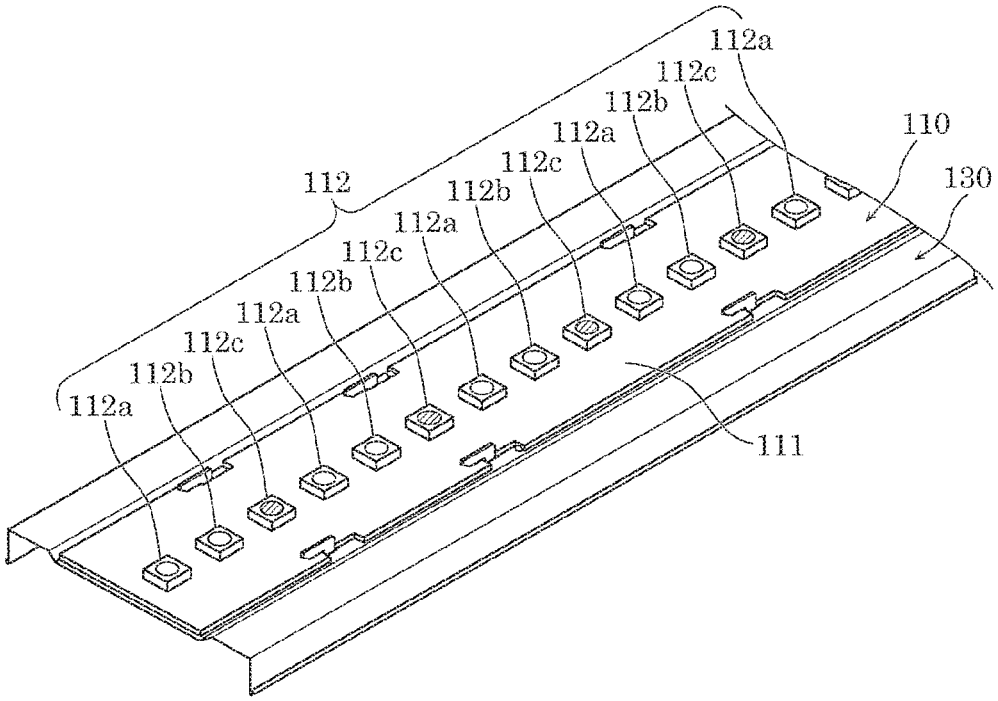
FIG. 15 illustrates a configuration of a light emitter in an illumination apparatus according to Variation 2.

In this case, as illustrated in FIG. 15, LED elements 112 may include first LED elements 112*a* which are white LED light sources having a high color temperature (for example, 6500 K), second LED elements 112*b* which are white LED light sources having a low color temperature (for example, 2700 K), and third LED elements 112*c* which are red LED light sources. Note that in this variation, first LED element 112*a*, second LED element 112*b*, and third LED element 112*c* are alternately disposed one by one, yet the order in which first LED elements 112*a*, second LED elements 112*b*, and third LED elements 112*c* are disposed and how many of first LED elements 112*a*, second LED elements 112*b*, and third LED elements 112*c* are disposed alternately are not limited to the above.

Figure 16:
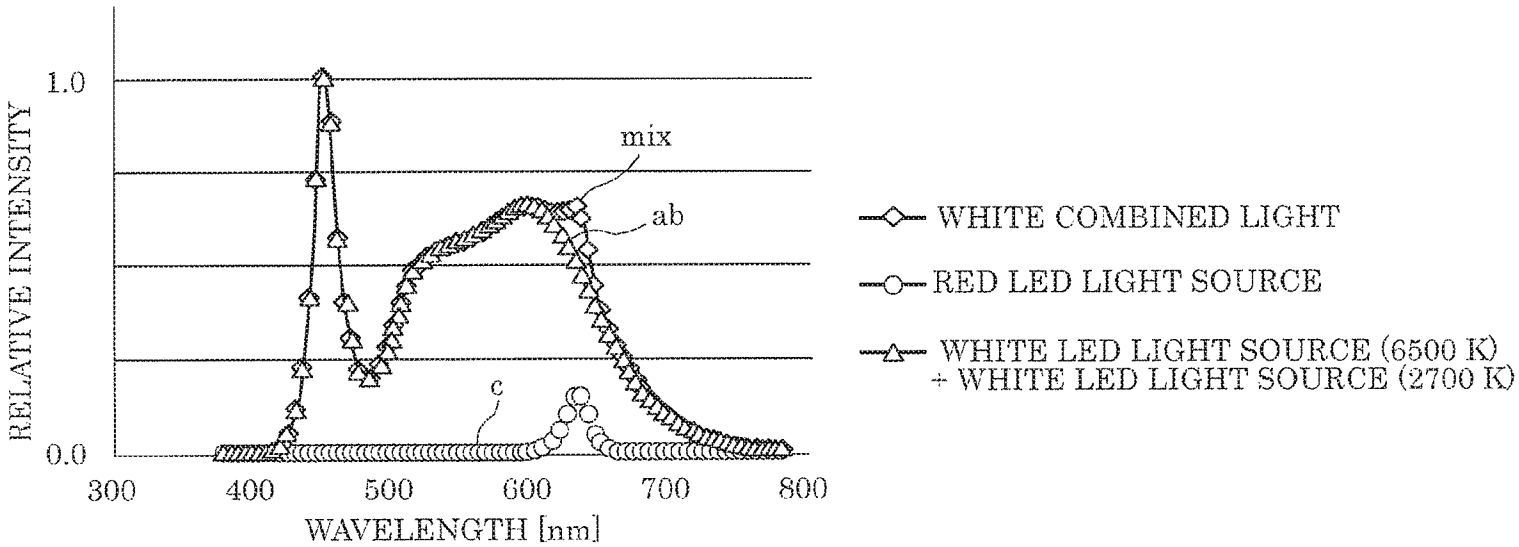
FIG. 16 illustrates a spectral distribution of light emitted by the light emitter and LED elements in the illumination apparatus according to Variation 2.

At this time, first LED elements 112*a* (white LED light sources) and second LED elements 112*b* (white LED light sources) emit light having spectral distribution ab illustrated in FIG. 16, third LED elements 112*c* (red LED light sources) emit light having spectral distribution c illustrated in FIG. 16, and if all first LED elements 112*a*, all second LED elements 112*b*, and all third LED elements 112*c* emit light, light emitter 110 emits light having spectral distribution mix illustrated in FIG. 16.

Accordingly, the color temperature is about 5000 K and color deviation Duv is about −4 in Variation 1 above, yet as in this variation, two types of white LED light sources and red LED light sources are combined to achieve the first illumination light, whereby a color temperature can be set to about 5000 K and color deviation Duv can be set to about −6. This achieves first illumination light which provides whiter appearance to obtain higher contrast. Accordingly, the visibility of text on a display is further improved.

Variation 3

In this variation, as LED elements 112, white LED light sources which emit white light having a correlated color temperature in a range from 5000 K to 7200 K, red LED light sources which emit red light having a main peak wavelength in a range from 600 nm to 640 nm, and green LED light sources which emit green light having a main peak wavelength in a range from 480 nm to 500 nm are used to achieve the first illumination light having the above optical characteristics.

Figure 17:
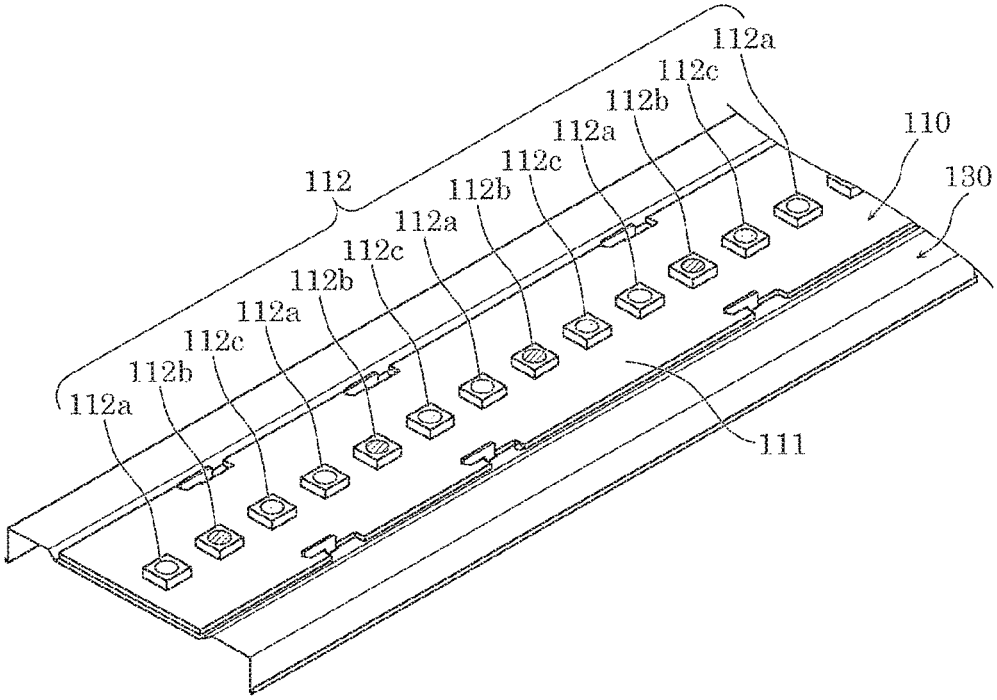
FIG. 17 illustrates a configuration of a light emitter in an illumination apparatus according to Variation 3.

In this case, as illustrated in FIG. 17, LED elements 112 may include first LED elements 112*a* which are white LED light sources, second LED elements 112*b* which are red LED light sources, and third LED elements 112*c* which are green LED light sources. Note that in this variation, first LED element 112*a*, second LED element 112*b*, and third LEI) element 112*c* are alternately disposed one by one, yet the order in which first LED elements 112*a*, second LED elements 112*b*, and third LED elements 112*c* are disposed and how many of first LED elements 112*a*, second LED elements 112*b*, and third LED elements 112*c* are disposed alternately are not limited to the above.

Figure 18:
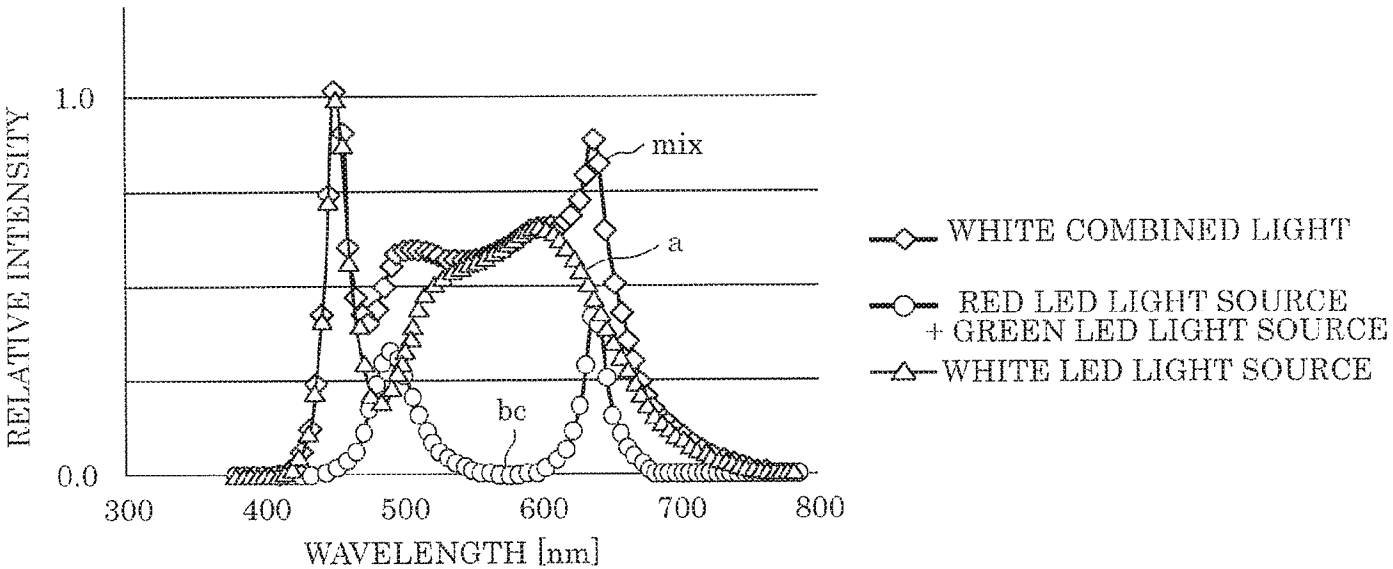
FIG. 18 illustrates a spectral distribution of light emitted by the light emitter and LED elements in the illumination apparatus according to Variation 3.

At this time, first LED elements 112*a* (white LED light sources) emit light having spectral distribution a illustrated in FIG. 18, second LED elements 112*b* (red LED light sources) and third LED elements 112*c* emit light having spectral distribution be illustrated in FIG. 18, and if all first LED elements 112*a*, all second LED elements 112*b*, and all third LED elements 112*c* emit light, light emitter 110 emits light having spectral distribution mix illustrated in FIG. 18.

As in this variation, the red LED light sources and the green LED light sources having a substantially complementary color relation are added in addition to the white LED light sources to achieve the first illumination light, whereby color ununiformity on a light-emitting surface (for example, the surface of light-transmitting cover 140) where poor color uniformity is readily noticeable can be reduced, in addition to improving the visibility of text on a display.

In this case, as illustrated in FIG. 17, a red LED light source and a green LED light source may be directly adjacent to each other. Accordingly, color ununiformity can be further reduced.

Other Variations

The above has described the illumination apparatuses according to the present disclosure based on the embodiments, yet the present disclosure is not limited to the above embodiments.

For example, in Embodiments 1 and 2 and the variations thereof described above, the illumination apparatuses are permanently disposed on a construction material such as the ceiling, yet the present disclosure is not limited to this, and the illumination apparatuses may be movable apparatuses like desk lamps.

Further, in Embodiments 1 and 2 and the variations thereof described above, light emitter 110 is an SMD LED module, yet the present disclosure is not limited thereto. For example, light emitter 110 may be a chip on board (COB) LED module. In this case, light emitter 110 includes substrate 111, one or more LED chips (bare chips) directly mounted on substrate 111 as LED elements 112, and a sealant such as a phosphor containing resin which seals the one or more LED chips.

The present disclosure may also include embodiments as a result of adding, to Embodiments 1 and 2 and the variations thereof described above, various modifications that may be conceived by those skilled in the art, and embodiments obtained by combining elements and functions in Embodiments 1 and 2 and the variations thereof described above in any manner without departing from the spirit of the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. An illumination apparatus, comprising:

a light emitter which emits first illumination light that is illumination light for illuminating a display screen, wherein, in a u'v' chromaticity diagram which is a CIE 1976 uniform chromaticity scale diagram, the first illumination light has a correlated color temperature in a range from 4000 K to 5800 K, and u'v' chromaticity coordinates in a range which satisfies $0.7125u'+0.3284<v'<0.7125u'+0.3339$, and wherein the first illumination light is emitted onto the display screen.

2. The illumination apparatus according to claim 1, wherein the light emitter includes:

a first white light emitting diode (LED) light source which emits first white light having a correlated color temperature in a range from 5000 K to 7200 K; and a second white LED light source which emits second white light having a correlated color temperature in a range from 2700 K to 3800 K, such that the first white light and the second white light form the first illumination light.

3. The illumination apparatus according to claim 1, wherein the light emitter includes:

a white LED light source which emits white light having a correlated color temperature in a range from 5000 K to 7200 K; and a red LED light source which emits red light having a main peak wavelength in a range from 600 nm to 650 nm, such that the white light and the red light form the first illumination light.

4. The illumination apparatus according to claim 1, wherein the light emitter includes:

a first white LED light source which emits first white light having a correlated color temperature in a range from 5000 K to 7200 K;

a second white LED light source which emits second white light having a correlated color temperature in a range from 2700 K to 3800 K; and a red LED light source which emits red light having a main peak wavelength in a range from 600 nm to 650 nm, such that the first white light, the second white light, and the red light form the first illumination light.

5. The illumination apparatus according to claim 1, wherein the light emitter includes:

a white LED light source which emits white light having a correlated color temperature in a range from 5000 K to 7200 K;

a red LED light source which emits red light having a main peak wavelength in a range from 600 nm to 640 nm; and a green LED light source which emits green light having a main peak wavelength in a range from 480 nm to 500 nm, such that the white light, the red light and the green light form the first illumination light.

6. The illumination apparatus according to claim 5, wherein the red LED light source and the green LED light source are directly adjacent to each other.

7. The illumination apparatus according to claim 1, wherein the light emitter further emits second illumination light that is illumination light for illuminating paper, and optical characteristics of the second illumination light include:

a correlated color temperature in a range from 5400 K to 7000 K;

a color deviation Duv in a range from −6 to 8; and a chroma value of at most 2.0, the chroma value being obtained using a calculation method specified in the CIE 1997 Interim Color Appearance Model (Simple Version).

8. The illumination apparatus according to claim 7, further comprising:

a controller which switches between a first mode for emitting the first illumination light and a second mode for emitting the second illumination light.

9. The illumination apparatus according to claim 1, further comprising:

a controller which controls the light emitter.

10. The illumination apparatus according to claim 1, further comprising:

a base which supports the light emitter; and a light-transmitting cover which covers the light emitter.

11. The illumination apparatus according to claim 10, wherein the light-transmitting cover has diffusibility.

12. The illumination apparatus according to claim 1, further comprising:

a controller which controls the light emitter, wherein:

the controller controls the light emitter to cause the first illumination light to have a constant correlated color temperature in a range from 4000 K to 5000 K during a first time period from a predetermined time in morning to around 3:00 p.m., the controller controls the light emitter to cause the first illumination light to have a correlated color temperature which increases in a range from 5000 K to 5800 K as time elapses during a second time period from around 3:00 p.m. to sunset, and the controller controls the light emitter to cause the first illumination light to have a constant color in a range from 4000 K to 5000 K during a third time period from sunset to a predetermined time in night.

13. The illumination apparatus according to claim 12, wherein a horizontal illuminance of the first illumination light in the predetermined space is at most 1000 lx.

14. The illumination apparatus according to claim 12, further comprising:

a light color detector which detects a light color, wherein the controller controls the light emitter, based on the light color detected by the light color detector, to cause the first illumination light to have a color according to color tuning control schedule information predetermined.

15. The illumination apparatus according to claim 14, further comprising:

a storage which stores the color tuning control schedule information.

16. An illumination control system, comprising:

an illumination apparatus comprising:

a light emitter which emits first illumination light that is illumination light for illuminating a display screen, wherein, in a u'v' chromaticity diagram which is a CIE 1976 uniform chromaticity scale diagram, the first illumination light has a correlated color temperature in a range from 4000 K to 5800 K, and u'v' chromaticity coordinates in a range which satisfies $0.7125u'+0.3284<v'<0.7125u'+0.3339$, and wherein the first illumination light is emitted onto the display screen;

a controller which controls the light emitter, wherein:

the controller controls the light emitter to cause the first illumination light to have a constant correlated color temperature in a range from 4000 K to 5000 K during a first time period from a predetermined time in morning to around 3:00 p.m., the controller controls the light emitter to cause the first illumination light to have a correlated color temperature which increases in a range from 5000 K to 5800 K as time elapses during a second time period from around 3:00 p.m. to sunset, and the controller controls the light emitter to cause the first illumination light to have a constant color in a range from 4000 K to 5000 K during a third time period from sunset to a predetermined time in night;

a light color detector which detects a light color, wherein the controller controls the light emitter, based on the light color detected by the light color detector, to cause the first illumination light to have a color according to color tuning control schedule information predetermined; and a storage which stores the color tuning control schedule information; and an operation input controller which operates the illumination apparatus, wherein the color tuning control schedule information is created according to a user operation on the operation input controller, and stored into the storage.

17. An illumination control system comprising:

a plurality of illumination apparatuses each of which comprises a light emitter which emits first illumination light that is illumination light for illuminating a display screen, wherein:

in a u'v' chromaticity diagram which is a CIE 1976 uniform chromaticity scale diagram, the first illumination light has a correlated color temperature in a range from 4000 K to 5800 K, and u'v' chromaticity coordinates in a range which satisfies $0.7125u'+0.3284<v'<0.7125u'+0.3339$, the first illumination light is emitted onto the display screen, the plurality of illumination apparatuses each include an illuminance detector which detects an illuminance in a predetermined space, and a controller included in a first illumination apparatus changes output of the first illumination light emitted by the light emitter included in the first illumination apparatus, to cause an illuminance in the predetermined space detected by the illuminance detector included in the first illumination apparatus to match an illuminance in the predetermined space detected by the illuminance detector included in a second illumination apparatus different from the first illumination apparatus, the first illumination apparatus and the second illumination apparatus being included in the plurality of illumination apparatuses.

18. An illumination control system, comprising:

an illumination apparatus comprising a light emitter which emits first illumination light that is illumination light for illuminating a display screen; and an operation input controller which receives input to operate the illumination apparatus, wherein, in a u'v' chromaticity diagram which is a CIE 1976 uniform chromaticity scale diagram, the first illumination light has a correlated color temperature in a range from 4000 K to 5800 K, and u'v' chromaticity coordinates in a range which satisfies $0.7125u'+0.3284<v'<0.7125u'+0.3339$, and wherein the first illumination light is emitted onto the display screen.

19. The illumination control system according to claim 18, wherein:

the illumination apparatus comprises a plurality of illumination apparatuses, and the operation input controller operates the plurality of illumination apparatuses.

* * * * *